United States Patent [19]

Koch

[11] 4,238,994

[45] Dec. 16, 1980

[54] METHOD AND APPARATUS FOR MONITORING AND CONTROLLING THE PRODUCTION OF COMPOSITE FILTER MOUTHPIECES FOR CIGARETTES OR THE LIKE

[75] Inventor: Friedo Koch, Wohltorf, Fed. Rep. of Germany

[73] Assignee: Hauni-Werke Körber & Co. KG, Hamburg, Fed. Rep. of Germany

[21] Appl. No.: 10,240

[22] Filed: Feb. 8, 1979

[30] Foreign Application Priority Data

Feb. 16, 1978 [DE] Fed. Rep. of Germany ..... 2806552

[51] Int. Cl.[3] ..... A24C 5/50

[52] U.S. Cl. ..... 493/4; 250/563; 493/13; 493/45; 493/47

[58] Field of Search ..... 93/77 FT, 1 C; 250/563, 250/562, 224

[56] References Cited

U.S. PATENT DOCUMENTS

| | | | |
|---|---|---|---|
| 3,016,464 | 1/1962 | Bailey | 250/224 X |
| 3,355,592 | 11/1967 | Muir | 250/224 |
| 3,399,606 | 9/1968 | Molins | 93/1 C |
| 3,729,635 | 4/1973 | Shottenfeld et al. | 250/562 |
| 4,001,579 | 1/1977 | Lebet et al. | 93/1 C X |

*Primary Examiner*—James F. Coan
*Attorney, Agent, or Firm*—Peter K. Kontler

[57] ABSTRACT

A continuous filter rod wherein dissimilar filter rod sections alternate with each other is monitored by a photosensitive detector which detects changes in the degree to which different sections absorb and/or reflect radiation. A pulse generator transmits signals for each unit length of the rod and such signals are multiplied and transmitted to several counters one of which ascertains whether or not the number of signals between two successive changes of the intensity of radiation is too low (this denotes that the length of filter rod sections of a certain type is insufficient), another of which ascertains whether or not the number of signals between two successive changes of the intensity of radiation is excessive (this denotes that the length of filter rod sections of a certain type is excessive), and a third of which ascertains whether or not the cutoff severs the filter rod at desired locations, e.g., midway across successive filter rod sections of a given type. Signals from the first and second counters are used to segregate the corresponding (defective) mouthpieces, and the signals from the third counter are used to adjust the filter rod making machine by changing the speed of that machine unit which assembles filter rod sections into a rod-like filler of the filter rod.

22 Claims, 3 Drawing Figures

METHOD AND APPARATUS FOR MONITORING AND CONTROLLING THE PRODUCTION OF COMPOSITE FILTER MOUTHPIECES FOR CIGARETTES OR THE LIKE

BACKGROUND OF THE INVENTION

The present invention relates to the manufacture of filter mountpieces for filter tipped rod-shaped smokers' products, and more particularly to improvements in a method and apparatus for making composite or multiplex filter mouthpieces which contain several dissimilar filter rod sections. Still more particularly, the invention relates to improvements in a method and apparatus for monitoring and controlling the operation of machines for the production of composite or multiplex filter mouthpieces.

As a rule, composite filter mouthpieces are produced in a machine which, in certain respects, resembles a cigarette rod maker. The machine comprises a first unit which assembles groups of dissimilar filter rod sections and a second unit which converts groups of dissimilar filter rod sections and a web of wrapping material into a continuous filter rod which is thereupon severed at regular intervals to yield a succession of discrete filter mouthpieces. The length of filter rod sections is often monitored by photoelectric or analogous means wherein a source emits a beam of radiation which is directed against the filter rod and a transducer generates electrical signals which denote the degree to which various sections absorb radiation.

The dissimilar filter rod sections may consist of entirely different filter materials or they may consist of an identical base material (such as acetate fibers) but with the base material in one type of sections interspersed with granulae of activated charcoal or the like. It is also possible to assemble the filler of the filter rod of filter rod sections some of which constitute gaps, i.e., columns of air between neighboring rod-shaped sections consisting of solid filter material. Still further, such gaps can be filled with granulae consisting of a suitable absorbent material to constitute rod-shaped sections which resemble rods solely because they are confined by the tubular wrapper of the filter rod and are flanked by rod-shaped sections consisting of acetate fibers, crepe paper or the like.

An important requisite for the manufacture of satisfactory composite or multiplex filter mouthpieces for use in the making of filter cigarettes, cigars or cigarillos is that each mouthpiece should contain a predetermined length of each of two or more different types of filter material, e.g., a first section of predetermined length which consists of acetate fibers with a paper wrapper therearound, a second section of predetermined length which consists of crepe paper, and a third section of predetermined length which is a column of air between the first and second sections or is adjacent to one of the first and second sections (the third section may constitute a non-self-supporting column of charcoal granulae or the like). The length of various sections of a composite filter mouthpiece can deviate from a desired or optimum length for a number of reasons, e.g., due to improper timing of the severing action upon the filter rod or owing to improper assembly of filter rod sections into a rod-like filler which is to be draped into a web of cigarette paper, imitation cork or other suitable wrapping material (e.g., the improper assembly may result from lengthwise shifting of solid-rod-like sections with attendant reduction or increase of the width of the aforementioned gaps). When a filter mouthpiece is severed across the gap to yield two shorter mouthpieces, each gap is converted into two recesses which are adjacent to the free ends of the respective filter mouthpieces in filter cigarettes or the like. Improper spacing of solid filter rod sections in the filter rod entails changes of the length of recesses.

On the other hand, the quality of certain filter mouthpieces is not adversely affected by defects which are attributable to eventual clearances between neighboring solid filter rod sections, especially if the width of such clearances is not excessive. Heretofore known apparatus for monitoring composite filter rods are incapable of accurately ascertaining the width of the just mentioned clearances; therefore, such apparatus are designed to invariably segregate each and every filter mouthpiece wherein two solid rod-shaped filter rod sections do not abut against each other. This results in an excessive number of rejects and is also undesirable on the aforementioned ground, namely, that the presence of relatively narrow clearances between two solid rod-like sections of the filler of a filter mouthpiece does not render such mouthpiece defective or useless.

An apparatus for monitoring the gaps between neighboring cigarettes of a file of coaxial cigarettes is disclosed in U.S. Pat. No. 3,355,592 to Muir. The patented apparatus comprises a photodetector in circuit with a capacitor which completes the holding circuit of a relay when it accumulates a predetermined charge. The charge of the capacitor is a function of the ratio of the length of cigarettes to the width of gaps between neighboring cigarettes. When the width of the gaps decreases, the charge of the capacitor also decreases whereby the holding circuit of the relay opens. The accuracy of the just described apparatus is very low and, furthermore, the apparatus can detect only a reduction of the width of gaps but is incapable of indicating whether or not the width of the gaps is excessive. Therefore, such apparatus cannot be used in a machine for the production of composite filter mouthpieces because the manufacturer is concerned primarily with detection of those filter mouthpieces wherein the width of the gaps is excessive. At the very least, the manufacturer wishes to ascertain those filter mouthpieces wherein the width of the gaps is insufficient as well as to pinpoint those mouthpieces wherein the width of the gaps is excessive.

OBJECTS AND SUMMARY OF THE INVENTION

An object of the invention is to provide a method of monitoring the production of filter mouthpieces and of undertaking the necessary measures when the length and/or other characteristics of portions of such mouthpieces deviate from a desired norm.

Another object of the invention is to provide a method of ascertaining the length of sections in a continuously moving composite filter rod for the purpose of segregating defective mouthpieces.

A further object of the invention is to provide a method of the above outlined character which can be restored to for automatically adjusting the production of composite filter mouthpieces when the length of at least one of several alternating sections which constitute the filler of the filter rod deviates from a prescribed length.

An additional object of the invention is to provide a monitoring apparatus which can be utilized for the practice of the above outlined method.

Another object of the invention is to provide a machine for the production of composite or multiplex filter mouthpieces which embodies or is combined with the improved monitoring apparatus.

One feature of the invention resides in the provision of a method of producing and controlling the production of composite filter mouthpieces for use in the manufacture of filter cigarettes or the like. The method comprises the steps of assembling a continuous filler rod consisting of several types of alternating dissimilar filter rod sections which absorb radiation to a different degree, conveying the filler rod lengthwise along a predetermined path, draping the filler rod into a web of wrapping material to form a continuous filter rod wherein the web constitutes a tube surrounding the filler rod, directing a beam of radiation (e.g., light) against one of the rods in a first portion of the path whereby different types of sections absorb or reflect radiation to a different degree, monitoring the characteristics of the beam subsequent to impingement upon the one rod and generating first signals in response to changes of such characteristics (preferably whenever the intensity of the beam increases or decreases), generating second signals in response to movement of successive unit lengths of the one rod past a second portion of the path (each such unit length is a small and preferably minute fraction of the overall length of a filter rod section of satisfactory length), and counting the number of second signals which are generated subsequent to generation of first signals.

The last mentioned (counting) step preferably comprises counting the number of second signals during each interval between the generation of two successive first signals; this is tantamount to ascertainment of the actual length of filter rod sections of a given type. Still further, the method preferably comprises the step of generating a third signal when the number of second signals during one of the aformentioned intervals is less than a predetermined first number (denoting that the respective section is too short), an additional signal when the total number of second signals during one of the intervals exceeds a preselected second number (denoting that the respective section is too long), and/or generating a further signal whenever the total number of second signals during one of the intervals is outside of a predetermined range. Such third, additional and/or further signals can be utilized for segregation of corresponding mouthpieces from satisfactory mouthpieces in the following way: The filter rod is subdivided into filter mouthpieces each of which contains at least a portion of a filter rod section of each type, the mouthpieces are conveyed along a second path, and the mouthpieces containing sections whose monitoring resulted in the generation of a third, additional, and/or further signal are expelled from the second path, e.g., by streams of a compressed gaseous fluid which are directed against the respective mouthpieces in the second path in response to generation of third, additional and/or further signals.

The one rod is preferably the filter rod. If filter rod sections of one type constitute columns of air in the tube, the aforementioned beam directing step may include directing the beam of radiation across the filter rod whereby the intensity of the beam which has penetrated through the filter rod portions containing the columns of air exceeds the intensity of the beam which has penetrated (if it has penetrated at all) the filter rod sections of the other type or types (e.g., filter rod sections consisting of or containing acetate fibers, granulae of activated charcoal or the like). The step of generating first signals them comprises generating such signals on movement of the leading and trailing ends of successive columns of air past the first portion of the path.

The counting of second signals can be used with equal advantage for ascertaining whether or not the filter rod is properly severed, i.e., whether or not the rod is severed across or between predetermined filter rod sections so that the resulting mouthpieces can intercept high percentages of nicotine, condensate, tar and/or other deleterious or presumably deleterious ingredients of tobacco smoke. This can be achieved by severing the rod in a third portion of the predetermined path, which third portion is located downstream of the second portion, and generating signals at a frequency proportional to that at which the filter rod is severed. The counting step then comprises counting the total number of second signals during the interval between the generation of a first signal and the generation of the next signal denoting the severing of the filter rod. A fourth signal is preferably generated when the total number of second signals within the last mentioned interval is outside of a predetermined range, namely, a range which denotes that the filter rod is severed at or close to the desired locations, e.g., midway across the centers of successive filter rod sections of a given type.

The sections of the filter rod may include alternating sections of a first and a second type. In monitoring such rods, the step of generating the first signals preferably includes monitoring the intensity of the beam which is alternately reflected by the sections of the first and second type. For example, the sections of the first type may consist of acetate fibers and cause a less pronounced reflection of light than the sections of the second type if the sections of the second type consist of charcoal granulae and/or have dark wrappers surrounding fillers of acetate fibers or other suitable filter material.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
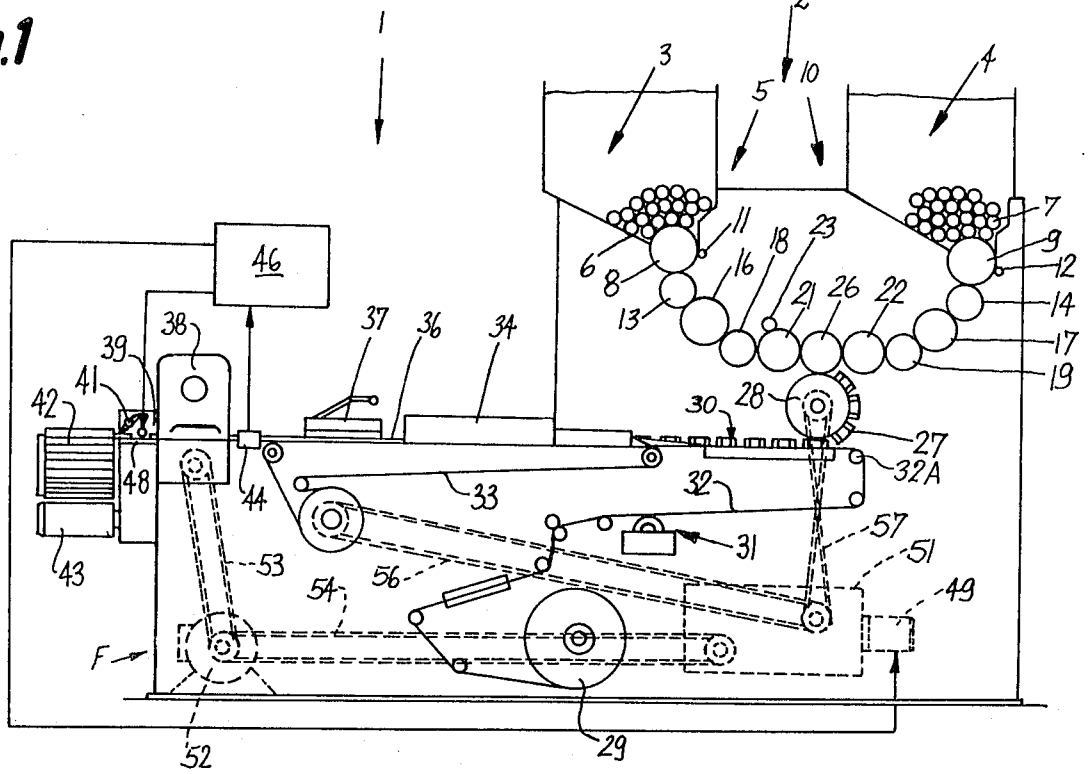
FIG. 1 is a schematic elevational view of a machine which is used for the production of composite filter mouthpieces and comprises a monitoring apparatus which is constructed and assembled in accordance with the invention.

The machine of FIG. 1 comprises two main units, namely an assembling unit 2 which serves to form a continuous rod-like filler or filler rod 30 consisting of filter rod sections of three different types, and a filter rod making unit 1 which converts the rod-like filler 30 and a web 32 of cigarette paper, imitation cork or other suitable flexible wrapping material into a continuous filter rod 36. The unit 1 comprises a cutoff 38 or analogous severing means with one or more orbiting knives which subdivide the rod 36 into a file of discrete filter mouthpieces or filter plugs 39 each of which contains at least a portion of a filter rod section of each type. A similar machine is disclosed in commonly owned U.S. Pat. No. 4,043,454 granted Aug. 23, 1977 to Reuland.

The assembling unit 2 comprises two magazines or hoppers 3 and 4, a rotary drum-shaped assembly conveyor 26, a transfer conveyor 28 which delivers groups 27 of filter rod sections from the assembly conveyor 26 onto the adjacent portion of the web 32, and two sets of conveyors (indicated at 5 and 10) which respectively manipulate the filter rod sections 6, 7 and transport the respective sections and their parts from the magazines 3, 4 to the assembly conveyor 26. The filter rod sections 6 are different from the filter rod sections 7. For example, the fillers of the filter rod sections 6 may consist exclusively of fibrous filamentary filter material (e.g., acetate fibers), and the fillers of filter rod sections 7 may consist of crepe paper or a fibrous filamentary material interspersed with particles of charcoal or other absorbent material.

The conveyors 5 include a rotary drum-shaped withdrawing conveyor 8 a portion of which extends into the outlet of the magazine 3 and which has peripheral receiving means in the form of flutes serving to transport discrete filter rod sections 6 sideways past a rotary disk-shaped knife 11. The latter severs each section 6 midway between its ends to form a pair of coaxial shorter sections of two times unit length each (each section 6 is assumed to be of four times unit length). The conveyor 8 delivers pairs of coaxial shorter sections to a rotary staggering conveyor 13 which comprises two drums or disks rotating at different speeds and/or transporting the respective shorter sections through different distances so that one shorter section of each pair is staggered with respect to the other shorter section of the same pair, as considered in the circumferential direction of the conveyor 13, before the thus staggered shorter sections are transferred into successive flutes of a rotary drum-shaped shuffling conveyor 16. The conveyor 16 cooperates with one or more stationary guide rails or analogous cam means (not shown) which cause some or all of the shorter sections to move axially (at right angles to the plane of FIG. 1) so that the thus shifted or shuffled shorter sections form a single row wherein each preceding shorter section is in exact register with the next-following shorter section. The flutes of the shuffling conveyor 16 transfer successive shorter sections into successive flutes of a rapidly rotating drum-shaped accelerating conveyor 18. The distance between successive flutes of the conveyor 18 exceeds the distance between successive flutes of the shuffling conveyor 16. The conveyor 18 delivers shorter filter rod sections into successive flutes of a rotary drum-shaped severing conveyor 21 which cooperates with a rotary disk-shaped knife 23 to subdivide each shorter section into two coaxial sections 6a (see FIG. 2) of unit length. The severing conveyor 21 further cooperates with a wedge-like plough or analogous spreading means for moving the sections 6a of each pair axially and away from each other (i.e., at right angles to the plane of FIG. 1) so that the sections 6a are separated from each other by a clearance having a width exceeding the length of a filter rod section 7a (see FIG. 2) of two times unit length. The thus separated pairs of filter rod sections 6a are thereupon transferred into successive flutes of the assembly conveyor 26.

Certain conveyors of the set 10 are identical with the corresponding conveyors of the set 5. Each filter rod section 7 in the magazine 4 is of four times unit length (twice the length of a section 7a). The outlet of the magazine 4 is adjacent to a portion of a withdrawing conveyor 9 which is analogous to the conveyor 8 and whose peripheral flutes transport the withdrawn sections 7 seriatim past a rotary disk-shaped knife 12 which subdivides each section 7 into two coaxial filter rod sections 7a of double unit length. The conveyor 9 delivers successive pairs of sections 7a to the drums or disks of a staggering conveyor 14 which corresponds to the conveyor 13 and shifts one section 7a of each pair relative to the other section (as considered in the circumferential direction of the conveyor 14) prior to transferring individual sections 7a into successive flutes of a rotary drum-shaped shuffling conveyor 17 corresponding to the conveyor 16. The conveyor 17 cooperates with one or more guide rails or like cam means to shift some or all of the sections 7a axially in order to form a single row wherein each preceding section 7a is in exact alinement with the next-following section 7a. The row of sections 7a is located in such a way that, when the sections 7a of such row are admitted into successive flutes of the assembly conveyor 26 (via intermediate rotary drum-shaped conveyors 19 and 22), each section 7a is located between two sections 6a of unit length. Each of the aforementioned groups 27 consists of three filter rod sections, namely, two spaced-apart sections 6a of unit length and a filter rod section 7a of double unit length between the respective sections 6a.

Successive groups 27 are thereupon caused to advance between two guide rails (not shown) which cause at least one of the sections 6a to move axially toward the respective section 7a so as to condense each group 27, i.e., to insure that both sections 6a abut against the respective end faces of the section 7a therebetween. The thus condensed groups 27 are then delivered to the transfer conveyor 28 which constitutes a turn-around device because it changes the orientation of successive groups 27 by 90 degrees prior to deposition of such groups on the adhesive-coated upper side of the running web 32. The conveyor 28 transfers the groups 27 in such a way that the neighboring groups which adhere to the web 32 are separated from each other by gaps (filter rod sections) 58 of predetermined width (see FIG. 2).

The web 32 is withdrawn from a bobbin or reel 29 which is rotatable in or on the frame F of the filter rod making machine. One side of the web 32 is coated (at least partially) with adhesive during travel along a paster 31, and the web 32 thereupon travels around a guide roller 32A which causes the adhesive-coated side to face upwardly in the region below the transfer conveyor 28. The adhesive insures that the sections 6a, 7a of the filler 30 cannot move axially or otherwise with respect to each other and that the neighboring groups 27 are separated from each other by the aforementioned filter rod sections or gaps 58. Furthermore, the adhesive coats at least one marginal portion of the web 32 in order to insure that the web can be converted into a tube during travel through a wrapping mechanism 34 of the unit 1. The mechanism 34 drapes the web 32 around the filler 30 so that the web is converted into a tubular envelope or wrapper the aforementioned marginal portion of which overlies the outer side of the other marginal portion to form therewith a seam which extends lengthwise of the resulting continuous filter rod 36. The seam is heated or cooled by a sealer 37 (depending upon whether the adhesive which is applied by the paster 31, and which may but need not coat an entire side of the web 32, is a so-called wet or cold adhesive which sets in response to heating or a heat-activatable adhesive, known as hotmelt, which sets in response to cooling). The means for drawing the web 32 off the bobbin 29 and for transporting the web along a predetermined path through and beyond the wrapping mechanism 34 comprises an endless belt conveyor 33 known as garniture. The rod 36 is severed at regular intervals by the cutoff 38 to yield a single file of discrete composite filter mouthpieces or plugs 39 of double unit length. Successive filter mouthpieces 39 are accelerated by a rapidly rotating cam 41 which propels them into successive flutes of a rotary drum-shaped row forming conveyor 42. The conveyor 42 converts the single file of filter mouthpieces 39 into one or more rows wherein the filter mouthpieces travel sideways and are deposited on the upper reach of a belt conveyor 43 which transports the filter mouthpieces to a further processing station, e.g., to the assembly conveyor of a filter tipping machine wherein each mouthpiece 39 is assembled with two plain cigarettes of unit length to form therewith a filter cigarette of double unit length.

Figure 2:
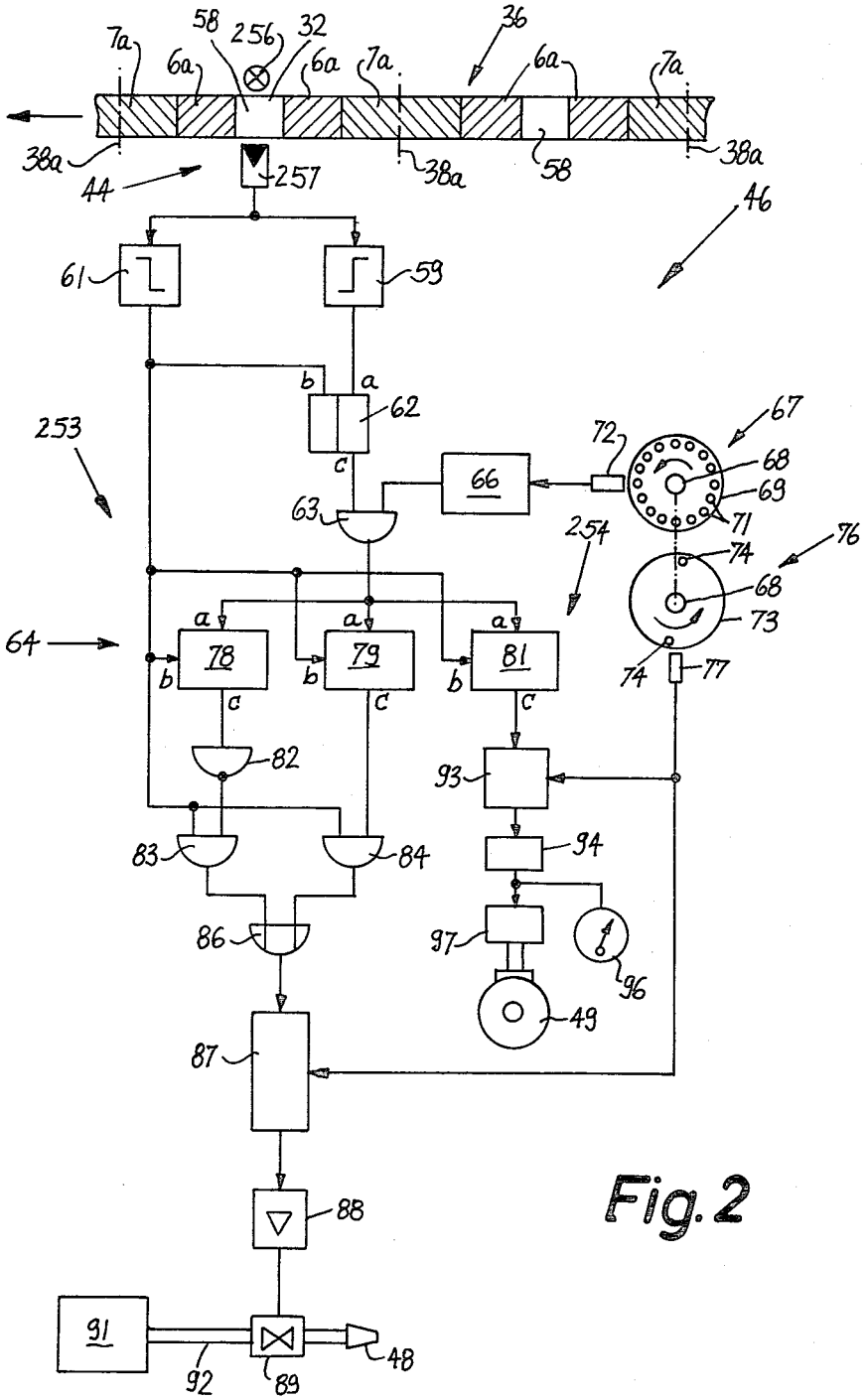
FIG. 2 is an enlarged axial sectional view of a portion of the filter rod, a diagrammatic view of the detector which monitors the absorption of radiation by various sections of the filter rod, and a diagrammatic view of a control circuit which receives (first) signals from the detector and serves to effect segregation of defective mouthpieces and/or adjustments in the operation of the unit which assembles filter rod sections into a continuous filter rod.

The cutoff 38 is preceded by a detector 44 which monitors the rod 36 downstream of the sealer 37. The output of the detector 44 transmits signals to the input of a control circuit 46 the details of which (as well as the details of the detector 44) are shown in FIG. 2. An output of the control circuit 46 transmits signals (when necessary) to an ejector 48 which is mounted between the cutoff 38 and the accelerating cam 41 and serves to segregate defective filter mouthpieces 39, i.e., unsatisfactory filter mouthpieces are not permitted to enter the flutes of the row forming conveyor 42. Another output of the control circuit 46 transmits signals to a servomotor 49 which can change the ratio of an infinitely variable speed transmission 51. The input element of the transmission 51 receives torque from a main prime mover 52 (e.g., a D.C. motor) which is mounted in the frame F and drives the input element of the transmission 51 by way of a toothed belt or chain drive 54. A second toothed belt or chain drive 53 transmits torque from the output element of the prime mover 52 to the moving parts of the cutoff 38, and additional toothed belt or chain drives 56, 57 respectively transmit motion from the output element of the transmission 51 to the garniture 33 and the transfer conveyor 28. The transmission 51 may constitute a differential gearing of known design.

The output element of the transmission 51 further drives all or nearly all moving parts of the assembling unit 2, e.g., by way of the transfer conveyor 28. Thus, save for certain auxiliary aggregates (such as the knives which sever the filter rod sections and the grinding means for such knives), all moving parts of the filter rod making machine receive motion from the main prime mover 52, either directly (see the cutoff 38) or indirectly (via transmission 51). This is of advantage because the rate at which the groups 27 are deposited on the running web 32 can be altered independently of the rate at which the cutoff 38 severs the filter rod 36 and vice versa.

The details of the control circuit 46 are shown in FIG. 2. This circuit includes two branches 253 and 254. The branch 253 serves to detect those sections (6a, 7a or 58) of the filter rod 36 whose length is outside of an acceptable range of lengths, and the branch 254 serves to monitor the location of the plane in which successive filter sections 7a are severed by the knife or knives of the cutoff 38 as well as to effect necessary adjustments if the sections 7a are not severed exactly or nearly exactly midway between their ends. The planes in which the knife or knives of the cutoff 38 sever the rod 36 are indicated by phantom lines, as at 38a.

The branches 253 and 254 receive signals from the radiation-sensitive transducer 257 of the detector 44. The latter is a photosensitive monitoring means which includes a light source 256 at one side of the path for the filter rod 36 and the transducer 257 which is located at the other side of such path opposite the light source. The optical element or elements which focus the beam of radiation issuing from the source 256 upon the photosensitive surface of the transducer 257 are not shown in FIG. 2.

Each gap 58 constitutes a discrete filter plug which consists of a column of air and is disposed between the neighboring filter rod sections 6a of unit length. The beam of radiation which issues from the source 256 can penetrate through the gaps 58 to impinge upon the transducer 257; however, such beam is intercepted by each filter rod section 6a or 7a. In other words, the web 32 transmits light but the light cannot penetrate through the fillers of the sections 6a and/or 7a.

The output of the transducer 257 is connected with two signal generators 59 and 61. Each of these signal generators is a differentiating circuit of the type known as IK-FLIP-FLOP, and these circuits are designed in such a way that the output of the circuit 59 transmits a (first) signal in response to a positive change of intensity or another characteristic of the signal at the output of the transducer 257 whereas the output of the circuit 61 transmits a (first) signal in response to a negative change of such characteristic. The outputs of the signal generators 59, 61 are respectively connected with the setting input a and the signal erasing input b of a flip-flop circuit 62 whose output c transmits a signal in response to arrival of a signal at the input a. The transmission of a signal to the input b erases the signal at the output c of the circuit 62. The output c of the flip-flop circuit 62 serves to transmit signals to one input of an AND gate 63 whose output transmits signals to a counter circuit 64. The other input of the AND gate 63 receives signals from a pulse generator 67 by way of a signal multiplying circuit 66. The circuit 66 may constitute a PLL- and counter circuit. The input of this circuit receives signals from a proximity detector 72 which is adjacent to the path of movement of magnets 71 on a disk 69 of the pulse generator 67. The shaft 68 of the disk 69 is driven in synchronism with the cutoff 38, i.e., directly by the main prime mover 51. In fact, the shaft 68 may constitute the drive shaft of the cutoff 38. The shaft 68 further carries the disk 73 of a second pulse generator 76. The disk 73 is provided with two magnets 74 which actuate a proximity detector 77. The number of magnets 74 (two in FIG. 2) equals the number of orbiting knives in the cutoff 38. The disk 69 is provided with sixteen magnets 71, i.e., the proximity detector 72 transmits eight signals during each interval between two successive severing actions upon the filter rod 36. Otherwise stated, the filter rod 36 advances through a distance corresponding to the length of one-eighth of a filter mouthpiece 39 during each interval between the transmission of consecutive signals to the input of the signal multiplying circuit 66. The multiplying factor is thirtysix, i.e., the right-hand input of the AND-gate 63 receives two hundred eightyeight (second) signals during each interval between two successive severing steps.

The counter circuit 64 comprises three adjustable counters 78, 79 and 81. The counters 78, 79 form part of the branch 253, and the counter 81 forms part of the branch 254. The counters 78 and 79 are threshold circuits i.e., their outputs c respectively transmit signals when their inputs a receive a predetermined minimum number of (second) signals and when the number of (second) signals exceeds the predetermined maximum permissible number. On the other hand, the intensity of signal at the output c of the counter 81 is indicative of the total number of (second) signals which are transmitted to the input a. The arrangement is such that the intensity of signal at the output c of the counter 81 is zero when the number of signals at the input a equals a predetermined number, that the signal at the output c is a positive signal when the number of signals transmitted to the input a exceeds such predetermined number, and that the signal at the output c is a negative signal when the number of signals transmitted to the input a is less than the predetermined number. The counter 81 is a decade counter with a system of resistors which enable the output to transmit analog signals denoting the number of signals tramsmitted to the input.

The inputs a of the counters 78, 79 and 81 are connected with the output of the AND gate 63, and the erasing or resetting inputs b of these counters are connected to the output of the signal generator 61. The counters 78 and 79 can be replaced with a single counter having two outputs one of which transmits a signal when the input of the single counter receives a first number of signals and the other of which transmits a signal when the input receives a second number of signals. The two outputs of such single counter are then connected to the setting inputs of two discrete flip-flop circuits whose erasing inputs are connected to the output of the signal generator 61.

The output c of the counter 78 is connected with one input of an AND gate 83 via inverter 82, and the output c of the counter 79 is connected with one input of a further AND gate 84. The other inputs of the AND gates 83 and 84 are connected to the output of the signal generator 61. The outputs of the AND gates 83 and 84 are connected with the first stage of a shift register 87 by way of an OR gate 86. The stages of the shift register 87 transmit signals from the OR gate 86 to an amplifier 88 in response to signals which are transmitted by the proximity detector 77, i.e., whenever the cutoff 38 severs the filter rod 36. The inverter 82 and the AND gates 83, 84 can be said to constitute an evaluating circuit for the signals which are transmitted by the outputs c of the adjustable threshold circuits or counters 78 and 79. The output of the amplifier 88 is connected with a solenoid-operated valve 89 which is installed in a conduit 92 connecting a source 91 of compressed air with the aforementioned ejector 48. The latter is a nozzle which discharges a stream of compressed air against a defective filter mouthpiece 39 in the path between the cutoff 38 and the accelerating cam 41 to expel such filter mouthpiece into a collecting receptacle, not shown, i.e., to prevent entry of a defective filter mouthpiece into the oncoming peripheral flute of the row forming conveyor 42. The evaluating means including the gates 83, 84 and 86 can ascertain, at any time, the number of signals which were transmitted to the counters 78, 79 by the circuit 66 during an interval beginning with transmission of a signal from the signal generator 59 and ending with transmission of a signal by the signal generator 61. The ascertainment is sufficiently accurate to insure that the nozzle 48 ejects all mouthpieces 39 which are so defective that they should be segregated from mouthpieces which reach the conveyor 42. Thus, that number of (second) signals which suffices to cause the transmission of a signal to inverter 82 but does not suffice to cause the transmission of a signal to the AND gate 84 denotes a satisfactory number of second signals. When the inverter does not receive a signal, the respective gap 58 is too short, and when the gate 84 receives a signal, the respective gap 58 is too long.

The output c of the counter 81 is connected with one input of an adjustable analog switch 93 which constitutes an evaluating circuit for the signals transmitted by the counter 81. The output of the switch 93 transmits signals at predetermined intervals, and such signals denote the intensity of signal which, at such time, indicates the number of (second) signals received by the counter 81. Another input of the analog switch 93 receives signals from the proximity detector 77, i.e., such signals are transmitted at the rate at which the knives of the cutoff 38 sever the filter rod 36. The output of the switch 93 is connected with an averaging circuit 94 whose output is connected with an indicating gauge 96 as well as with the servomotor 49 for the transmission 51 by way of a regulating circuit 97.

The unit 2 is less likely to produce sections 6*a* or 7*a* of unsatisfactory length than the knives of the cutoff 38 (such knives sever the sections 7*a*). The second branch 254 of the control circuit 46 takes care of such defects by transmitting signals for changing the speed ratio of the transmission 51.

The operation of the control circuit 46 is as follows:

The branch 253 serves to ascertain the length of gaps 58 between filter rod sections 6*a*. Since the disks 69 and 73 are driven by the shaft 68 of the cutoff 38, the signals which are transmitted by the proximity detectors 72, 77 of the pulse generators 67, 76 are generated in synchronism with the operation of cutoff 38 and also in synchronism with the speed of forward or lengthwise movement of the filter rod 36 because the garniture 33 receives motion from the drive 56 which, in turn, receives motion from the prime mover 52 via drive 54 and transmission 51.

When the beam of radiation issuing from the source 256 of the detector 44 penetrates across a gap 58, the intensity of radiation which penetrates through the convoluted web 32 suffices to cause the transducer 257 to transmit a signal to the inputs of the signal generators 59 and 61. Since the transducer 257 did not transmit a signal prior to entry of a gap 58 between the components 256, 257 of the detector 44, the signal at the output of the transducer 257 is a positive signal (i.e., its intensity exceeds the intensity of the signal (zero) which was transmitted prior to arrival of a gap 58 into the space between the components 256 and 257) whereby the output of the signal generator 59 transmits a signal to the setting input a of the flip-flop circuit 62 whose output c transmits a signal to the corresponding input of the AND gate 63. Consequently, each of the (second) signals which are transmitted to the AND gate 63 via signal multiplying circuit 66 is transmitted to the inputs a of the counters 78, 79 and 81. Since the counter 81 forms part of the branch 254, its function will be disregarded during the immediately following part of the description of operation of the control circuit 46. The counters 78 and 79 count the (second) signals which are transmitted by the output of the AND gate 63, and the output c of the counter 78 transmits a signal when the number of signals at its input a reaches a predetermined number, namely, that number which is indicative of the minimum acceptable width of a gap 58. The output c of the counter 79 transmits a signal when its input a receives a second predetermined number of signals, namely, a number which is indicative of an excessive width of the gap 58 (as considered in the axial direction of the filter rod 36).

When the gap 58 advances beyond the space between the components 256, 257 of the detector 44, the transducer 257 transmits a negative signal (zero) because the beam of radiation is intercepted by the oncoming filter section 6*a*, whereby the signal generator 61 transmits a signal to the erasing input b of the flip-flop circuit 62, to the erasing and resetting inputs b of the counters 78, 79, 81, and to the corresponding inputs of the AND gates 83 and 84. The signal at the output c of the flip-flop circuit 62 disappears and, therefore, the output of the AND gate 63 ceases to transmit (second) signals from the multiplying circuit 66 to the inputs a of the counters 78, 79 and 81.

The signal which is transmitted from the output of the signal generator 61 to the AND gates 83 and 84 results in the transmission of a signal from the AND gate 83 to the first stage of the shift register 87 if the inverter 82 transmits a signal to the right-hand input of the AND gate 83, i.e., if the output c of the counter 78 does not transmit a signal denoting that the width of the just monitored gap 58 satisfies the minimum width requirement. The output of the gate 84 transmits a signal to the first stage of the shift register 87 if its right-hand input receives a signal from the output c of the counter 79, i.e., if the width of the just monitored gap 58 is excessive. The shift register 87 is a time-delay device which transports the signal from the gate 83 or 84 to the amplifier 88 at a speed corresponding to the speed of movement of the defective filter mouthpiece 39 (namely, of that filter mouthpiece wherein the width of the gap 58 is excessive or insufficient) to a position of register with the orifice or orifices of the ejector nozzle 48.

The signal which is transmitted from the output of the signal generator 61 to the inputs b of the counters 78, 79 and 81 results in resetting of these counters with a certain delay which suffices to insure that the gate 83 or 84 can transmit a signal to the shift register 87 in the event that the width of the just monitored gap 58 is unsatisfactory. The manner in which the shift register 87 advances a "defect" signal in synchronism with the movement of the corresponding defective mouthpiece 39 in order to effect timely energization of the solenoid of the valve 89 and ejection of the respective mouthpiece 39 is known in the art of making rod-shaped smokers' products.

The branch 254 of the control circuit 46 serves to insure that each filter section 7*a* is severed midway between its ends. As mentioned above, the input a of the counter 81 receives (second) signals when the AND gate 63 transmits signals to the counters 78 and 79, i.e., as soon as the leading end of a gap 58 enters the space between the parts 256, 257 of the detector 44. The detector 44 is mounted at a predetermined distance from the plane in which the knives of the cutoff 38 penetrate into and begin to sever the moving rod 36. Such distance can be ascertained with utmost accuracy so that it is possible to set the counter 81 in such a way that the latter transmits a signal of predetermined intensity when an increment of the rod 36 covers the aforementioned distance between the detector 44 and the plane of initial penetration of a knife into the rod 36. Thus, the input a of the counter 81 begins to receive signals from the circuit 66 (via gate 63) when the leader of a gap 58 reaches the space between the parts 256, 257 of the detector 44, and the transmission of signals to the counter 81 is terminated by the next signal from the detector 77 which denotes the next-following penetration of a knife into the filter rod 36, or vice versa. If the number of signals which are stored in the counter 81 at the time the right-hand input of the analog switch 93 receives a signal from the detector 77 matches a preselected number which is indicative of the fact that the section 7*a* in the region of the cutoff 38 is about to be severed midway between its ends, the output c of the counter 81 does not transmit a signal and, consequently, the ratio of the transmission 51 remains unchanged because the circuit 87 does not receive a positive or negative signal. The signal from the detector 77 activates the switch 93 for transmission of a signal; however, and since the upper input of the switch 93 receives no signal from the output c of the counter 81, the switch 93 does not transmit signals to the gauge 96 and regulating circuit 97 for the servomotor 49, i.e., the ratio of the transmission 51 remains unchanged.

If the proximity detector 77 transmits to the switch 93 a signal before the counter 81 receives the aforementioned preselected number of (second) signals from the multiplying circuit 66, the locus where the filter rod 36 is severed by a knife of the cutoff 38 is too close to the respective gap 58. The output c of the counter 81 then transmits a negative signal to the switch 93 and the latter transmits a signal with a negative sign to the averaging circuit 94. If the locus where the filter rod 36 is severed is too distant from the next-following gap 58, the output c of the counter 81 transmits a positive signal (excessive number of second signals transmitted by the circuit 66) and the switch 93 transmits to the averaging circuit 94 an impulse with a positive sign. The signal at the output of the averaging circuit 94 persists until the switch 93 receives a fresh signal from the proximity detector 77.

The positions of magnets 74 on the disk 73 with respect to the proximity detector 77 (i.e., the angular position of the disk 73) can be readily selected in such a way that the counter 81 can be reset in response to a signal from the signal generator 61, i.e., the new position of the locus where the filter rod is to be severed by the cutoff 38 can be ascertained with a minimum of delay (a small number of signals from the detector 77 to the switch 93).

The signal at the output of the averaging circuit 94 results in appropriate adjustment of the position of the pointer of the gauge 96 (for observation by an attendant), and such signal is also transmitted to the regulating circuit 97 which causes the servomotor 49 to rotate clockwise or counterclockwise, depending on the (plus or minus) sign of the signal from the counter 81 and switch 93. The servomotor 49 changes the ratio of the transmission 51 and hence the speed at which the conveyor 28 transfers groups 27 onto the web 32 as well as the speed of the garniture 33 (rod 36). The speed of the cutoff 38 remains unchanged because the cutoff is driven directly by the prime mover 52. This insures that the plugs 7a are severed midway between their ends. The extent of permissible deviations from an ideal cut is determined by setting of the averaging circuit 94, i.e., the latter selects a desired range of acceptable severing actions at both sides of the ideal position.

Figure 3:
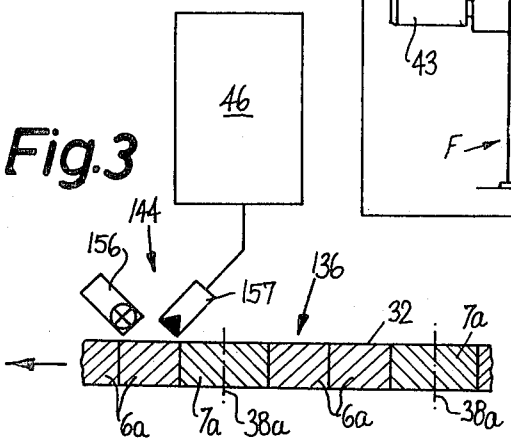
FIG. 3 is an axial sectional view of a portion of a modified filter rod and a diagrammatic view of a modified detector which determines the absorption of radiation by the sections of the rod-like filler which forms part of the modified filter rod.

FIG. 3 illustrates a modified detector 144 which comprises a light source 156 and a transducer 157 located in the path of light that is reflected by the tubular wrapper of the filter rod 136. The rod 136 is assembled of dissimilar filter rod sections 6a and 7a and is without gaps or filter rod sections corresponding to the gaps 58 shown in FIG. 2. Such rod can be produced in the machine of FIG. 1 by using filter rod sections 6 each of which is subdivided into six sections 6a and by using filter sections 7 each of which is subdivided into three filter sections 7a. The conveyor 28 is then set to deliver groups 27 at such a rate that the front section 6a of each next-following group 27 on the web 32 abuts against the rear end face of the trailing section 6a of the preceding group 27.

It is assumed that the fillers of sections 6a in the rod 136 are darker than the fillers of sections 7a, e.g., because the fibrous fillers of the sections 6a are interspersed with charcoal. Alternatively, the wrappers of individual sections 6a may be darker than the wrappers of individual sections 7a (or vice versa). In each instance, the intensity of radiation which is reflected by a rod portion which contains a darker section 6a or 7a is less pronounced than the intensity of radiation which is reflected by a rod portion which contains a lighter section 7a or 6a. Thus, the control circuit 46 receives signals of varying intensity, and the control circuit then processes such signals in a manner substantially as described above in connection with FIG. 2 (or in an analogous manner) to ascertain the length of discrete sections 6a or 7a as well as the distance between a locus of abutment of two neighboring sections 6a, 7a and the plane where the knives of the cutoff (not shown in FIG. 3) begin to penetrate into the filter rod 136. This renders it possible to effect segregation of defective filter mouthpieces as well as appropriate adjustment of the speed of the transmission which drives the transfer conveyor and the garniture. The operation of the reflection type photoelectric detector of FIG. 3 is based on the principle that darker and lighter portions of the rod 136 absorb different amounts of radiation which is emitted by the source 156. The difference between the radiation absorbing or reflecting characteristics of the sections 6a and 7a must be sufficiently pronounced to insure that the transducer 157 can produce signals which can be detected by the signal generators 59, 61 of the control circuit 46 to generate appropriate signals for transmission to the circuit 62, counters 78, 79, 81 and gates 83, 84.

A filter rod will be formed with gaps 58 in order to make sure that the outermost filter rod section 6a or 7a is not immediately adjacent to the outermost end of a filter tip which forms part of a filter cigarette, cigar or cigarillo. As shown in FIG. 2, each filter mouthpiece 39 comprises two sections 6a which flank a gap 58 and are flanked by two half sections 7a. Such mouthpiece 39 is of double unit length. In a filter tipping machine, the mouthpiece 39 is placed between two plain cigarettes of unit length and is connected thereto by an adhesive-coated uniting band. The resulting filter cigarette of double unit length is thereupon severed midway between its ends, i.e., midway across that portion of the convoluted uniting band which surrounds the gap 58, to yield two filter cigarettes of unit length. The mouthpiece of each filter cigarette of unit length contains one-half of a section 7a which is immediately adjacent to the plain cigarette, a filter rod section 6a which is outwardly adjacent to the half section 7a, and a recessed portion whose length equals half the width of a gap 58. Such recessed filters are preferred by many smokers because the nicotine-permeated filter material cannot contact the lips or the tongue during smoking.

An important advantage of the multiplying circuit 66 is that each of the counters 78, 79, 81 can receive a large number of (second) signals from the AND gate 63 during each interval between the transmission of a signal from the signal generator or differentiating circuit 59 and the transmission of a signal from the signal generator or differentiating circuit 61. This contributes to the accuracy of the monitoring operation and renders it possible to insure that the length of various sections of a satisfactory mouthpiece 39 does not deviate from an optimum or desired length by more than a minute fraction of one millimeter. Since the signal generators 59 and 61 transmit signals in response to detection of the leading and trailing ends of successive gaps 58, the length of such gaps can be ascertained with any desired degree of accuracy, depending on the multiplication factor of the circuit 66. As mentioned above, the signal generator 59 transmits a (first) signal when the monitoring means 44 detects the leader of a gap 58, and the signal generator 61 transmits a (first) signal when the monitoring means 44 detects the trailing end of the gap. The threshold circuits or counters 78, 79 insure that the nozzle 48 does not eject each and every mouthpiece 39 wherein the length of the gap 58 does not exactly match an optimum value. Thus, and as explained above, the AND gate 83 transmits a signal for ejection of the corresponding mouthpiece 39 when the number of (second) signals transmitted to the counter 78 during an interval between the transmission of signals by signal generators 59, 61 is less than a predetermined first number, and the AND gate 84 transmits a signal for ejection of the corresponding filter mouthpiece when the number of (second) signals received by the counter 79 during one of the aforementioned intervals exceeds a predetermined second number. Any number between the first and second numbers is satisfactory, i.e., the corresponding mouthpieces 39 are permitted to enter the row forming conveyor 42 and can be assembled with plain cigarettes, cigarillos or cigars to form filter tipped smokers' products. Since the counters 78 and 79 are adjustable, the predetermined first and second numbers can be selected by the attendant who thereby determines that minimum width and that maximum width of a gap 58 which warrants segregation of the corresponding filter mouthpiece 39.

The detector 144 of FIG. 3 can be used with equal advantage for monitoring of a filter rod 36 with gaps 58. The detector 144 then monitors the length of certain filter rod sections (*6a* or *7a*) and/or the length of gaps between certain filter sections. The control circuit 46 can cooperate with a detector 44 (in the same way as described in connection with FIG. 2) and with a detector 144 to ascertain the length of the sections *6a* or *7a*.

Still further, the conveyor set 5 or 10 of FIG. 1 can be deactivated or omitted, together with the corresponding magazine 3 or 4. The machine then produces a filter rod wherein sections *6a* or *7a* alternate with gaps. Such rod can be monitored by the detector 44 in the same way as described in connection with FIG. 2 or by the detector 144 if the sections *6a* or *7a* are sufficiently dark to insure that the transducer 157 will transmit a signal whenever it is bypassed by the leading or trailing end of a filter rod section in the wrapper of such rod.

Finally, the detector 44 or 144 and the control circuit 46 can be used with equal advantage to ascertain the absence of filter sectins *6a* or *7a*. For example, if the rod 136 of FIG. 3 exhibits a gap due to the absence of a section *6a* or *7a*, the circuit 44 can ascertain such defect in response to a signal from the detector 144 and the corresponding mouthpiece is ejected during travel past the nozzle 48.

The apparatus of FIG. 2 can automatically effect segregation of those filter mouthpieces wherein the width of the clearance or clearances (if any) between the filter rod sections *6a, 7a* at the one and/or the other side of the respective gap 58 is excessive. Thus, and let it be assumed that the first two sections *6a, 7a* shown in the upper part of FIG. 2 are separated from each other by a clearance which is due to unsatisfactory operation of the unit 2 and/or to improper transfer of the corresponding group 27 by the conveyor 28. The detector 44 detects such clearance in the same way as it detects a gap 58, and the counters 78, 79 count the number of (second) signals from the multiplying circuit 66 during that interval which elapses while the just discussed clearance travels past the detector 44, i.e., across the radiation beam which is emitted by the source 256 and impinges upon the transducer 257. As a rule, the width of the clearance will be less than the width of a satisfactory gap 58. Therefore, the counter 78 will not transmit a signal to the inverter 82 and the inverter 82 will transmit a signal to the AND gate 83 at the time when the latter receives a signal from the signal generator 61 (such signal denotes the detection of the trailing end of the clearance). Consequently, the first stage of the shift register 87 receives a signal and the nozzle 48 is caused to eject the corresponding mouthpiece 39 from the path between the cutoff 38 and the row forming conveyor 42.

As mentioned above, the apparatus can be used for simultaneous monitoring of the length of solid rod-shaped filter rod sections and of the width of gaps between certain solid rod-shaped sections if it embodies a detector 44 as well as a detector 144.

Without further analysis, the foregoing will so fully reveal the gist of the present invemntion that others can, by applying current knowledge, readily adapt it for various applications without omitting features that, from the standpoint of prior art, fairly constitute essential characteristics of the generica and specific aspects of my contribution to the art and, therefore, such adaptations should and are intended to be comprehended within the meaning and range of equivalence of the claims.

What is claimed is:

1. A method of producing and controlling the production of composite mouthpieces for use in the manufacture of filter cigarettes or the like, comprising the steps of assembling a continuous filter rod consisting of several types of alternating dissimilar filler rod sections which absorb radiation to a different degree; conveying the filler rod lengthwise along a predetermined path; draping the filler rod into a web of wrapping material to form a filter rod wherein the web constitutes a tube surrounding the filler rod; directing a beam of radiation against one of said rods in a first portion of said path whereby different types of sections absorb radiation to a different degree; monitoring the characteristics of said beam subsequent to impingement upon said one rod and generating first signals in response to changes of such characteristics; generating second signals in response to movement of successive unit lengths of sections of at least one type along said path, each unit length being a small fraction of the overall length of a section of satisfactory length; and counting the number of second signals which are generated subsequent to the generation of a first signal.

2. A method as defined in claim 1, wherein said last mentioned step comprises counting the number of second signals during intervals between the generation of successive first signals.

3. A method as defined in claim 2, further comprising the step of generating a third signal when the number of second signals during said intervals is less than a predetermined number.

4. A method as defined in claim 2, further comprising the step of generating an additional signal when the number of second signals during said intervals exceeds a preselected number.

5. A method as defined in claim 2, further comprising the step of generating a further signal when the total number of second signals during said intervals is outside of a predetermined range.

6. A method as defined in claim 5, further comprising the steps of subdividing said filter rod into filter mouthpieces, conveying said mouthpieces along a second path, and expelling from said second path each mouthpiece containing a section whose exposure to radiation resulted in the generation of a further signal.

7. A method as defined in claim 1, wherein said one rod is said filter rod and the filter rod sections of one of said types include columns of air in said tube, said directing step including directing said beam of radiation across said filter rod whereby the intensity of the beam which has penetrated through the tube portions surrounding said columns of air exceeds the intensity of the beam which has penetrated through filter rod sections of each other type, said step of generating said first signals including generating such signals on movement of the leading and trailing ends of successive columns past said first portion of said path.

8. A method as defined in claim 1, further comprising the steps of severing said filter rod at a predetermined frequency in a second portion of said path downstream of said first portion and generating third signals at said frequency, said counting step including counting the total number of second signals during each interval between the generation of a first signal and the generation of the next third signal.

9. A method as defined in claim 8, further comprising the step of generating fourth signals when the total number of second signals during said intervals is outside of a predetermined range.

10. A method as defined in claim 1, wherein said sections include alternating sections of a first type and a second type, said step of generating said first signals including monitoring the intensity of the beam which is alternately reflected by said sections of said first and second type.

11. Apparatus for producing and controlling the production of composite filter mouthpeices for use in the manufacture of filter cigarettes or the like, comprising means for assembling a rod-like filler consisting of several types of alternating dissimilar filter rod sections which absorb radiation to a different degree; conveyor means for moving the filler along a predetermined path; means for draping the filler into a web of wrapping material to form a filter rod wherein the web constitutes a tube surrounding the filler; detector means including a source a radiation arranged to direct a beam of radiation against said rod; means for generating first signals in response to variations of the intensity of said beam as a result of impingement upon dissimilar sections of said rod; means for generating second signals each of which denotes a unit length of said rod, said unit length being a small fraction of the length of a section of satisfactory length; signal generating counter means actuatable to count said second signals in response to said first signals; and means for evaluating the signals which are generated by said counter means.

12. Apparatus as defined in claim 11, wherein said means for generating said second signals includes a mobile pulse generator and means for moving said pulse generator in synchronism with the movement of said rod along said path.

13. Apparatus as defined in claim 11, wherein said means for generating said first signals includes a first signal generator arranged to transmit signals in response to detection of positive variations of the intensity of said beam and a second signal generator arranged to furnish signals in response to detection of negative variations of the intensity of said beam.

14. Apparatus as defined in claim 13, further comprising means for activating said counter means in response to transmission of signals by said first signal generator and for deactivating said counter means in response to transmission of signals by said second signal generator.

15. Apparatus as defined in claim 14, wherein said counter means includes a plurality of discrete counters.

16. Apparatus as defined in claim 15, wherein said counters include a first threshold circuit arranged to transmit signals when the number of second signals received during an interval between the transmission of signals from said first and second signal generators is less than a predetermined first number and a second threshold circuit arranged to transmit signals when the number of second signals received during an interval between the transmission of signals from said first and second signal generators exceeds a predetermined second number.

17. Apparatus as defined in claim 16, wherein said evaluating means comprises means for transmitting signals on transmission of signals by either of said threshold circuits.

18. Apparatus as defined in claim 11, further comprising severing means for subdividing said rod into discrete filter mouthpieces each of which contains at least a portion of a section of each of said types, and ejector means actuatable to segregate selected mouthpieces from other mouthpieces, said evaluating means comprising means for actuating said ejector means in response to reception of signals from said threshold circuits to segregate those mouthpieces whose monitoring by said detector means resulted in the transmission of signals by said threshold circuits.

19. Apparatus as defined in claim 11, wherein the sections of one of said types include columns of air and said source of radiation is disposed at one side of said path, said detector means further comprising radiation-sensitive transducer means disposed at the other side of said path substantially opposite said source to generate signals for transmission to said means for generating said first signals on passage of the leading and trailing ends of successive columns of air between said source and said transducer means.

20. Apparatus as defined in claim 11, further comprising mobile severing means for subdividing said rod into discrete filter mouthpieces each of which contains at least a portion of a section of each of said types, and means for generating additional signals in response to each severing of said rod, said counter means including a counter which is actuatable to count said second signals in response to transmission of a first signal and deactivatable in response to transmission of an additional signal.

21. Apparatus as defined in claim 20, wherein said evaluating means comprises means for indicating the number of second signals transmitted to said counter during each interval between the transmission of a first signal and the transmission of the next-following additional signal.

22. Apparatus as defined in claim 11, wherein said filler consists of rod-like sections of a first type and a second type, said detector means further including radiation-sensitive transducer means connected with said means for generating said first signals and disposed in the path of the beam which is reflected by successive sections of the filler in said rod to generate signals denoting the intensity of the reflected beam.

* * * * *